US005161310A

United States Patent [19]

Stoot

[11] Patent Number: 5,161,310

[45] Date of Patent: Nov. 10, 1992

[54] SIGHTING DEVICE FOR AN ARCHERY BOW

[76] Inventor: Joseph L. Stoot, 1296 Pleasantridge Dr., Altadena, Calif. 91001

[21] Appl. No.: 810,212

[22] Filed: Dec. 18, 1991

Related U.S. Application Data

[63] Continuation-in-part of Ser. No. 736,511, Jul. 26, 1991, abandoned.

[51] Int. Cl.[5] ..... F41G 1/40

[52] U.S. Cl. ..... 33/265

[58] Field of Search ..... 33/265; 124/87

[56] References Cited

U.S. PATENT DOCUMENTS

| | | | |
|---|---|---|---|
| 915,670 | 3/1909 | Gibbs | 33/233 |
| 3,136,063 | 6/1964 | Stebbins | 33/265 |
| 4,745,686 | 5/1988 | Willis | 33/254 |
| 4,953,302 | 9/1990 | Gould | 33/265 |
| 4,977,678 | 12/1990 | Sears | 33/265 |

*Primary Examiner*—Harry N. Haroian
*Attorney, Agent, or Firm*—Frederick Gotha

[57] ABSTRACT

A combined sighting and stabilizer device for an archery bow is set forth which includes a support body having a vertical axis, a pair of framing arms which are oppositely and laterally spaced from the vertical axis and in one embodiment of the invention extend rigidly from the support body to frame a target region which has sufficient area to permit an arrow to pass through the region. A stabilizer arm extends perpendicularly from the target region and is carried by the support body. The stabilizer arm has a threaded end which threads into the standard stabilizer bushing of the archery bow riser. A lock nut which is carried on the threaded end of the stabilizer arm is utilized to align the vertical axis of the support body with the vertical axis of the archery bow. In another embodiment of the invention, the framing arms are adjustably and slideably mounted to the support body such that the area of the target region may be varied.

27 Claims, 5 Drawing Sheets

SIGHTING DEVICE FOR AN ARCHERY BOW

FIELD OF THE INVENTION

This is a continuation-in-part of Application Serial No. 07/736,511 filed July 26, 1991, now abandoned.

This invention relates to a sighting device for an archery bow which frames the target and permits the arrow to pass through the sight on its flight toward the target.

BACKGROUND OF THE INVENTION

Sighting devices for archery bows generally are classified in two categories, namely pin sights and crosshair sights. There is considerable variation in the design of pin sights where such designs may include multiple leveling bubbles, built-in range finding windows, quick-adjust levers and other options which tend to make such pin sights bulky and difficult to use when hunting game. Cross-hair bow sights generally have a vertical wire and several horizontal cross wires where the vertical wire assists the archer in holding the bow near the vertical and the horizontal cross-hair assists the archer in estimating the distance to the target. There are also pendulum bow sights incorporating aiming pins which operate on the principle that as the archer aims downward at various angles, the aiming pin rotates upward or downward to compensate for the shooting distance to the target. These types of sights are relatively complicated and fragile and the angle range finding principle is not accurate beyond 30 to 35 yards.

Electronic bow sights are also utilized which contain pin beads that electronically light up an appropriate sight pin based upon the distance of the target while also flooding the cross-hair wires with a beam of light. The lighted cross hairs assist the archer in effectively finding a cross hair against the background of various types of shaded terrain.

Without the use of a sighting device, the archer will sight a target by instinct; the hunter draws down on the target, whether a circle on cardboard or an animal, and releases the arrow by feel. The archer must judge the distance and direction to the target by interpretation of the surrounding terrain. When in familiar surroundings, an archer can make judgments which are accurate. However, when the archer is in the woods where there are varying conditions of terrain and elevation, the estimations of distance and elevation are much more difficult to assess while at the same time focusing on an intended target.

Bow sights are variously mounted to the side of the bow handle. Most bow sights bolt rigidly to the side of the bow; however, dovetail mounts are also used which permit the bow hunter to selectively mount the sight either behind and to the side of the bow handle or to the front and side of the bow thus giving the hunter the option of determining which position of the bow sight is more suitable for reticle clarity. Under either option, the sight does not frame the arrow and the target together.

Calibration of the various individual sight devices is an important factor in the accuracy of the sight device and particularly so when the archer is hunting game. Although sophisticated bow sight aids allow accurate estimate of range such devices are mechanical in use and inhibit instinctive range finding by the hunter.

SUMMARY OF THE INVENTION

There is, therefore, provided according to the present invention, an archery bow sighting and stabilizer device of simple construction which is easily attachable to the standard bushing provided by the bow manufacturer in the bow riser. The sighting and stabilizer device of this invention extends from and is mounted to the front of the bow and permits the arrow, after release to pass through the framing region of the sight while on its flight toward the target.

The device comprises in one embodiment a support body which has a vertical axis and a stabilizer arm extending from the support body in a direction perpendicular to the plane of the framing region and the vertical axis. In another embodiment of the invention not shown the stabilizer arm is normal to a horizontal line in the plane of the framing region and forms an acute angle with the vertical axis. The stabilizer arm is threaded for threaded engagement with the standard stabilizer bushing provided by bow manufacturers in the bow riser. A pair of axially extending framing arms form the boundary of the framing region and are carried by the support body. The framing arms are symmetrical in design and equally and oppositely spaced from the vertical axis. The proximate end portions of the framing arms are integrally attached to the support body and the distal ends of the framing arms form a sighting window which in the preferred embodiment is approximately one inch in width measured laterally and symmetrically about said vertical axis.

In another embodiment of the device of this invention, the framing arms are slideably mounted to the support body to permit the vertical distance between the target window and the support body to be adjustable.

In yet another embodiment, the distal ends of the framing arms are interconnected by a bridge member which spans the sight window. The bridge member has aiming indicia such as a V-notch or a sharp protruberance which is in vertical alignment with the vertical axis of the support body for training or directing the vertical axis into alignment with a target.

In another embodiment, the framing arms are a continuous framing member which has aiming indicia such as a V-notch or a sharp protrusion which is in vertical alignment with the vertical axis of the support body for training or directing the vertical axis into alignment with the target.

Thus, a bow sight and stabilizer device is provided which is simple in construction and easily mounted to the riser of the archer's bow by threading the sight device into the standard stabilizer bushing provided in the riser by the manufacturer. The sighting device requires little calibration other than aligning the vertical axis of the device with the vertical axis of the bow. In difficult and unknown terrain, the archer in targeting game, frames the target within the framing region of the sight while sighting down the arrow shaft. This permits the archer to narrow his field of vision and assists him in pinpointing the target by focusing on the tip of the arrow. The field of vision is enhanced since the sight is located in front of the bow; and since the arrow passes through the sight, the archer is enabled to estimate the distance of the target more accurately. The use of pins for sighting is thereby eliminated and the target becomes the point of aim. Instinctive aiming of the arrow by elevating the bow up or down is thus minimized while the archer quickly picks up the target in the sight window. Since the sight also acts as a stabilizer, the necessity of additional cumbersome equipment is eliminated.

BRIEF DESCRIPTION OF THE DRAWINGS

These and other features and advantages will become appreciated as the same become better understood with reference to the following specification, claims and drawings wherein:

FIG. is a perspective view of the stabilizer and sighting device attached to the bow riser.

DETAILED DESCRIPTION

Figure 1:
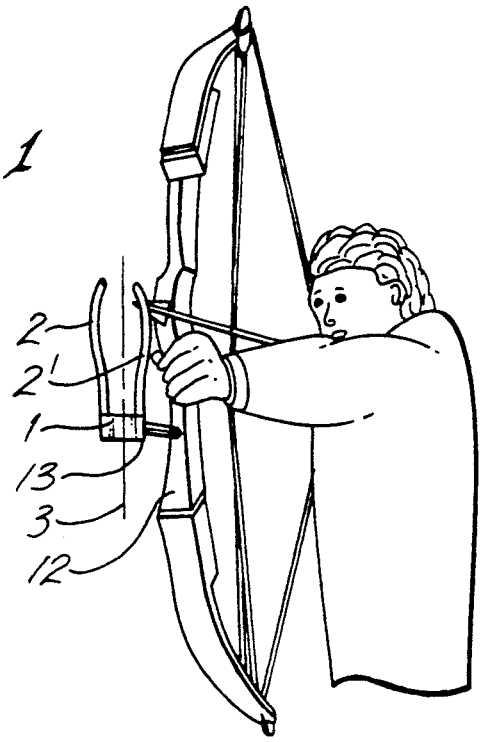
Figure 2:
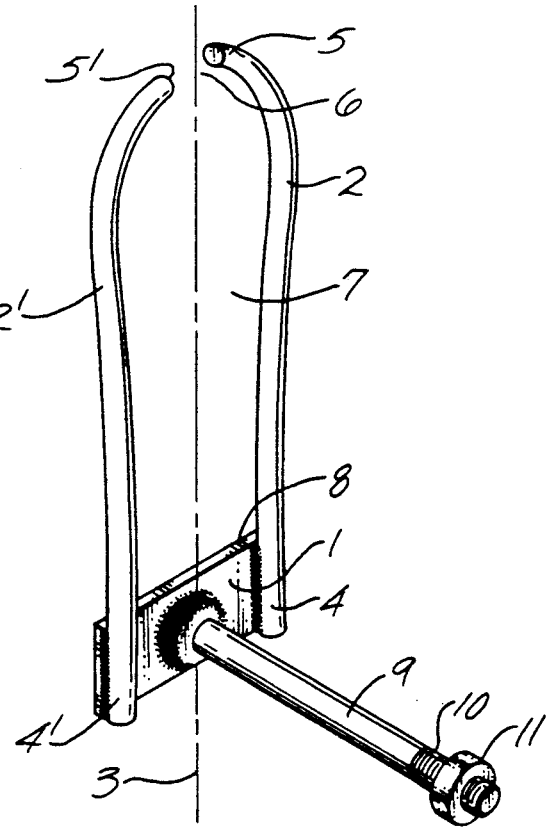
FIG. 2 is a perspective view of the device illustrating the stabilizer arm, framing arms and support body for the device.

The drawing shown in FIG. 1 depicts the invention mounted to the bow riser with the bow having been drawn to the point of anchor by the archer. As can be seen in FIG. 2, the stabilizer and sighting device of this invention has a support body 1 to which a pair of framing arms 2 and 2' are rigidly and integrally attached. Framing arms 2 and 2' initially extend axially from support body 1 in a direction parallel to vertical axis 3 and thereafter transition into a curvature which is concave relative to the vertical axis. Framing arms 2 and 2' are mirror images in design. The proximate ends 4 and 4' of the framing arms in one embodiment of this invention are integrally attached to the support body by welding. The distal ends 5 and 5' of framing arms 2 and 2' may be laterally displaced from each other and in the preferred embodiment are by a lateral distance of approximately 1 inch to form a sight gap or sight window 6. The target region 7 is framed by framing arms 2 and 2', peripheral edge 8 of support body I, and the sight gap 6. In the preferred embodiment, the framing arms are preferably made of ¼ inch diameter metal stock having a projected vertical length of approximately seven inches. Support body I is preferably a flat plate having a length of 2¼ inches, a width of 1" and a thickness of ⅛".

Referring again to FIG. 2, a stabilizer arm 9 is integrally attached to support body and extends perpendicularly from the plane formed by framing arms 2 and 2' and vertical axis 3 of the sighting device. To accommodate ready threaded insertion of the stabilizer arm into the standard stabilizer bushing 13 in the bow riser 12, stabilizer arm 9 has a diameter of 5/16" with a threaded end 10 and lock nut 11 to look the device to the bow after vertical axis 3 of the device and the vertical axis of the bow are in alignment.

Figure 3:
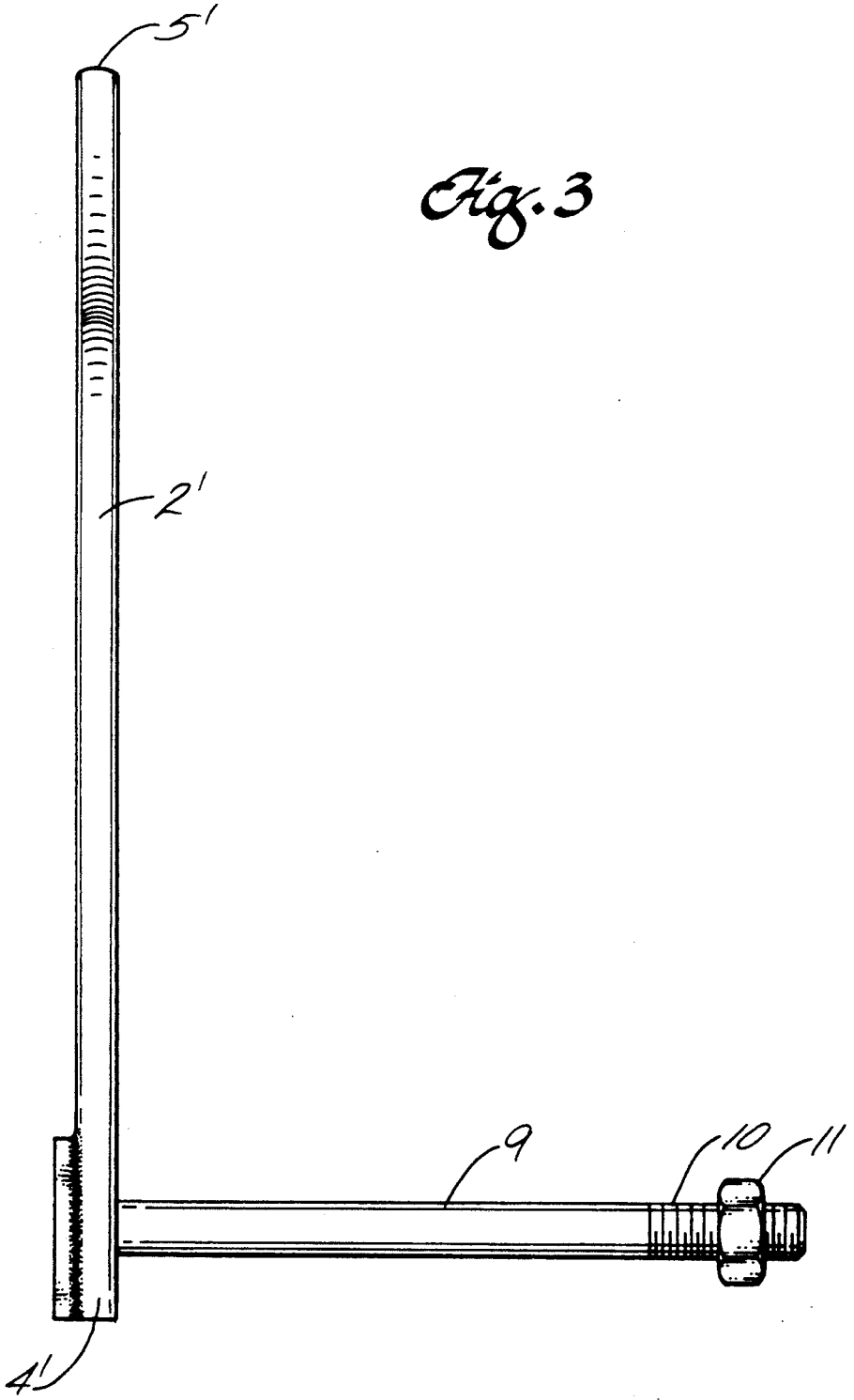
FIG. 3 is a side-elevational view of the stabilizer and sighting device illustrated in FIG. 2.

FIG. 3 is a elevational left side view of FIG. 2 and illustrates the relative lengths of the stabilizer arm and framing arms of the device. In the preferred embodiment, the length of stabilizer arm 9 is approximately 4 inches.

Figure 4:
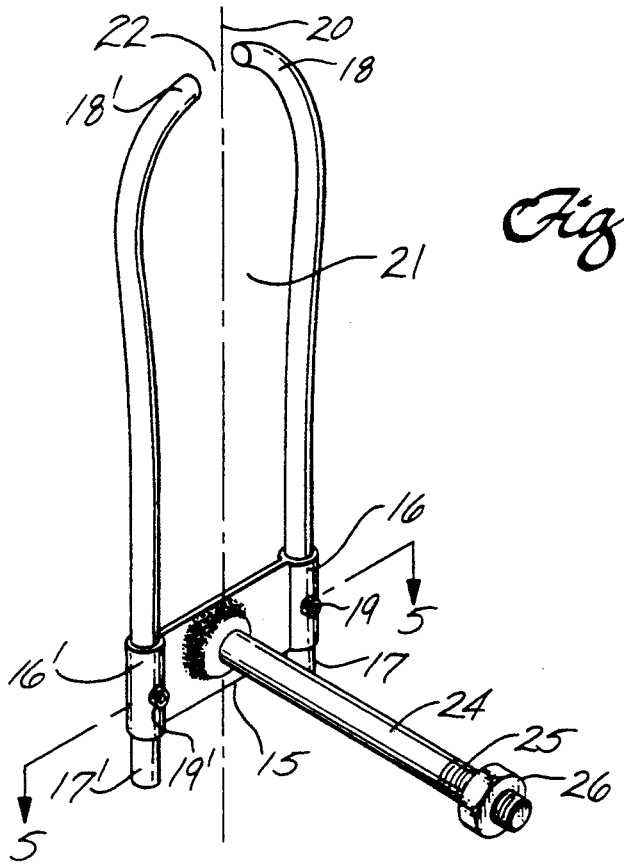
FIG. 4 is a perspective view of another embodiment of the stabilizer and sighting device where the framing arms are vertically adjustable.
Figure 5:
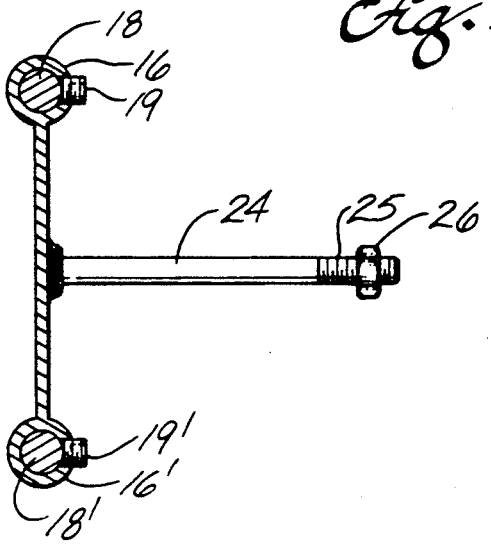
FIG. 5 is a cross-sectional view of FIG. 4 along line 5—5.

Referring now to FIG. 4, another embodiment of the invention is illustrated. In this embodiment, the support body is designed to permit axial extension and retraction of framing arms 18 and 18' which are slideably and adjustably mounted to the support body. As can be seen in FIG. 4, support body 15 has a pair of cylindrical receptors 16 and 16' for receiving the proximate ends 17 and 17' of framing arms 18 and 18'. Set screws 19 and 19, permit framing arms 18 and 18' to be axially adjustable in the direction of vertical axis 20 such that the area of target region 21 may be adjusted according to the personal preferences of the archer. This also permits the vertical adjustment of sight gap or sight window 22 formed by the distal ends 23 and 23' of framing arms 18 and 18

As in the preferred embodiment, this embodiment of the invention utilizes stabilizer arm 24 which has a threaded end 25 for threaded attachment into the standard bushing 13 for stabilizers located in the bow riser 12. Locking nut 26 is used to lock the stabilizer and sighting device such that the vertical axis 20 of the device is aligned with the vertical axis of the bow.

Although I have recommended in the preferred embodiment of this invention a sight gap or sight window width of 1 inch, this distance is not a critical distance in the use of the sighting device. Likewise, the length of the support body in the preferred embodiment was recommended to be 2 ¼ inches; this dimension is also not a critical dimension in the functioning of the device and is an approximation to provide sufficient distance between the framing arms so that an arrow may pass therebetween.

Figure 6:
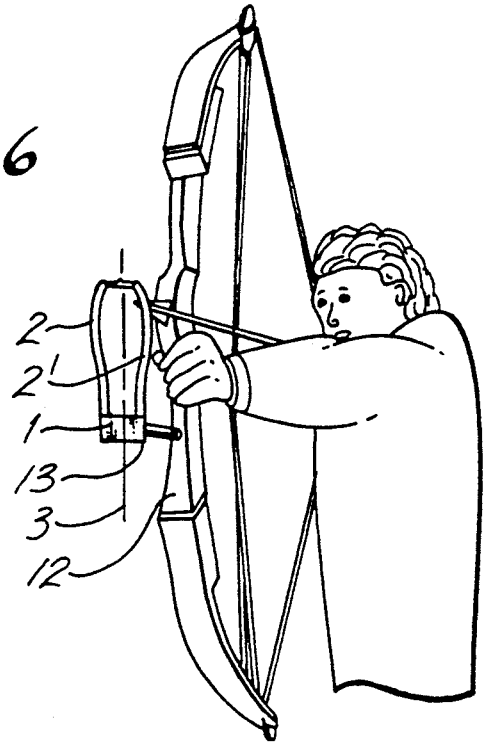
FIG. 6 is a perspective view of the stabilizer and sighting device with a bridge member interconnecting the distal ends of the framing arms of the sighting device.
Figure 7:
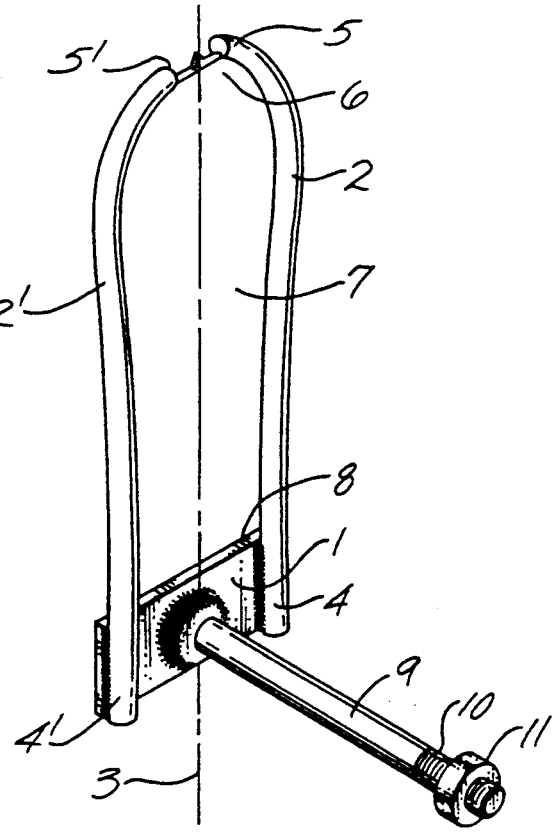
FIG. 7 is a perspective view of another embodiment of the sighting device illustrating the stabilizer arm, the framing arms with a bridge member having a sharp projection interconnecting the distal ends of the framing arms and support body for the device.

FIG. 6 depicts another embodiment of this invention where a bridge member 14 interconnects the distal ends 23 and 23' of the framing arms 2 and 2'. As can be more clearly seen in FIG. 7, bridge member 14 has a sharp protruberance 28 which is in vertical alignment with vertical axis 3. In aiming an arrow, vertical axis 3 is trained or directed into alignment with a target when sharp protruberance 28 is superimposed on the target. Other aiming indicia such as a V-notch (not shown), perform the same function as sharp protruberance 28. Thus, bridge member 14 may contain a V-notch which is vertically aligned with vertical axis 3 thus permitting the training or directing of vertical axis 3 into alignment with a target when the aiming indicia (V-notch) is aligned with the target.

Figure 8:
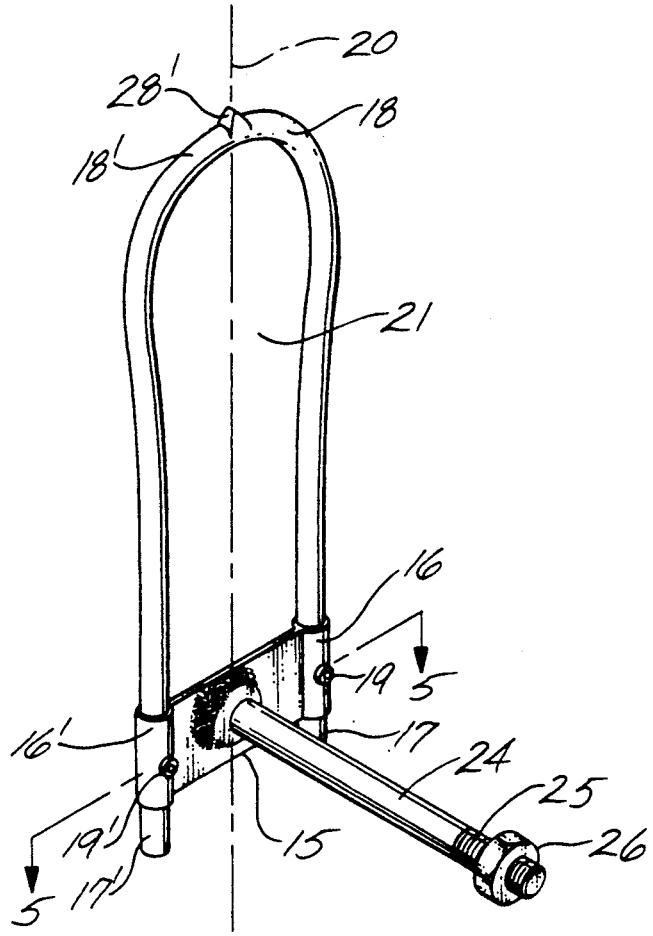
FIG. 8 is a perspective view of another embodiment of the stabilizer and sighting device where the framing arms form a continuous framing member having aiming indicia in vertical alignment with the vertical axis of the support body.
Figure 8A:
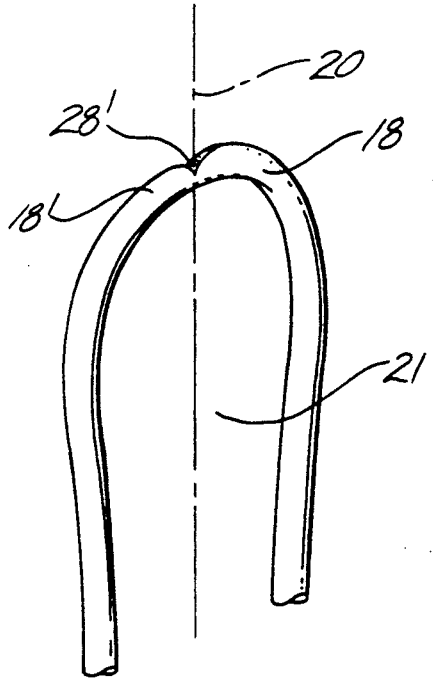
FIG. 8*a* is a partial perspective view of another embodiment of the stabilizer and sighting device illustrating the V- notch aiming indicia.

FIG. 8 illustrates yet another embodiment of the invention. As can be seen in FIG. 8, framing arms 18 and 18' form a continuous frame member 29 which frames the target region 2!. An aiming indicia 28' which in the figure is shown as a sharp protrusion is in vertical alignment with vertical axis 20 of support body 15. Aiming indicia 28' could also be a V-notch contained in frame member 29 or a distinguishable mark on the frame member where the mark is in vertical alignment with the vertical axis 20 of the support body.

In the embodiments of this invention shown in the figures, the stabilizer arm has been shown to be perpendicular to the plane of the target region. However, although not shown in the figures, the stabilizer arm may be normal to a horizontal line in the framing region which permits the plane of the framing region to be sloped and still permit an arrow to pass through the framing region on its flight toward the target.

Thus a stabilizer and sighting device is provided which is of a simple and sturdy construction and requires little calibration in order to be used. The archer merely screws the device into a standard bushing provided by bow manufacturers in the bow riser and locks the device by tightening a lock nut after the vertical axis of the device and the vertical axis of the bow are in alignment. The sight device is an aid to the archer when aiming at a target by narrowing the field of vision and allows the archer to pinpoint the target by focusing on the tip of the arrow. Since the sight is located in front of the bow and the arrow after release passes through the target region formed by the framing arms of the sight, the archer is enabled to instinctively estimate target distance.

While I have shown and described a certain embodiment of a stabilizer and sighting device, it is to be understood that it is subject to many modifications without departing from the spirit and scope of the claims recited herein.

What is claimed is:

1. A sighting device for an archery bow comprising:

a. a support body having a vertical axis;

b. a pair of framing arms oppositely and laterally spaced from said axis and extending from said support body so as to frame a target region, said target region having sufficient area to permit an arrow to pass therethrough;

c. a stabilizer arm in fixed relationship to and carried by said support body and extending from said support body in a direction normal to a horizontal line in the plane of said target region; and d. attachment means associated with said stablizer arm and said archery bow for attaching said stabilizer arm to said archery bow such that said vertical axis may be aligned with the vertical axis of said archery bow.

2. The sighting device recited in claim 1 wherein said framing arms have distal ends which are sufficiently removed laterally to form a sight window.

3. The sighting device recited in claim wherein said framing arms are adjustably and slideably mounted to said support body such that said area of said target region may be varied.

4. The sighting device recited in claim 3 wherein said framing arms have distal ends which are sufficiently removed laterally to form a sight window.

5. An improved sighting device for use with an archery bow having a riser and a stabilizer bushing mounted in said riser, comprising:

a. a support body having a vertical axis;

b. a pair of framing arms having proximate and distal ends, said framing arms oppositely and laterally spaced from said axis and extending from said support body so as to frame a target region, said target region having sufficient area to permit an arrow to pass therethrough;

c. a stabilizer arm mounted in fixed relationship to and carried by said support body and extending from said support body in a direction normal to a horizontal line in the plane of said target region; and d. attachment means associated with said stabilizer arm for attaching said stabilizer arm to said stabilizer bushing such that said vertical axis may be aligned with the vertical axis of said archery bow.

6. The improved sighting device recited in claim 5 wherein said distal ends are sufficiently removed laterally to form a sight window.

7. The improved sighting device recited in claim 5 wherein said framing arms are adjustably and slideably mounted to said support body such that said area of said target region may be varied.

8. The improved sighting device recited in claim 7 wherein said distal ends are sufficiently removed laterally to form a sight window.

9. The sighting device recited in claim-1 wherein said stabilizer arm extends from said support body in a direction substantially perpendicular to the plane of said target region.

10. The sighting device recited in claim 5 wherein said stabilizer arm extends from said support body in a direction substantially perpendicular to the plane of said target region.

11. The sighting device recited in claim further comprising aiming means associated with said framing arms where said aiming means has aiming indicia in substantial vertical alignment with said vertical axis of said support body for training said vertical axis of said support body into alignment with a target when said aiming indicia is aligned with said target.

12. The sighting device recited in claim 2 further comprising aiming means associated with-said framing arms where said aiming means has aiming indicia in substantial vertical alignment with said vertical axis of said support body for training said vertical axis of said support body into alignment with a target when said aiming indicia is aligned with said target.

13. A sighting device recited in claim 11 wherein said aiming indicia is a vertically extending protruberance.

14. The sighting device recited in claim 11 where said aiming indicia is a V-notch.

15. The sighting device recited in claim 12 wherein said training means comprises a bridge member extending between said framing arms and said aiming indicia is a vertically extending protruberance.

16. The sighting device recited in claim 12 wherein said training means comprises a bridge member extending between said framing arms and said aiming indicia is a Vnotch contained in said bridge member.

17. The sighting device recited in claim 5 further comprising aiming means associated with said framing arms where said aiming means has aiming indicia in substantial vertical alignment with said vertical axis of said support body for training said vertical axis of said support body into alignment with a target when said aiming indicia is aligned with said target.

18. The sighting device recited in claim 6 further comprising aiming means associated with said framing arms where said aiming means has aiming indicia in substantial vertical alignment with said vertical axis of said support body for training said vertical axis of said support body into alignment with a target when said aiming indicia is aligned with said target.

19. A sighting device recited in claim 17 wherein said aiming indicia is a vertically extending protruberance.

20. The sighting device recited in claim 17 where said aiming indicia is a V-notch.

21. The sighting device recited in claim 18 wherein said training means comprises a bridge member extending between said framing arms and said aiming indicia is a vertically extending protruberance.

22. The sighting device recited in claim 18 wherein said training means comprises a bridge member extending between said framing arms and said aiming indicia is a Vnotch contained in said bridge member.

23. A sighting device for an archery bow comprising:

(a) a support body having a vertical axis;

(b) a framing member carried by said support body and so dimensioned and proportioned to frame a target region where said target region has sufficient area to permit an arrow to pass therethrough;

(c) aiming means associated with said framing member and having aiming indicia in substantial vertical alignment with said vertical axis of said support body for training said vertical axis of said support body into alignment with a target when said aiming indicia is aligned with said target.

(d) a stabilizer arm in fixed relationship to and carried by said support body and extending from said support body in a direction normal to a horizontal line in the plane of said target region; and (e) attachment means associated with said stabilizer arm an said archery bow for attaching said stabilizer arm to said archery bow such that said vertical axis may be aligned with the vertical axis of said archery bow.

24. The sighting device recited in claim 23 wherein said framing member is adjustably and slideably mounted to said support body such that said area of said target region may be varied.

25. The sighting device recited in claim 23 wherein said stabilizer arm extends from said support body in a direction substantially perpendicular to the plane of said target region.

26. The sighting device recited in claim 23 wherein said aiming indicia is a vertically extending protrusion.

27. The sighting device recited in claim 23 wherein said aiming indicia is a V-notch.

* * * * *